US005985097A

United States Patent [19]

Samuelsson

[11] Patent Number: 5,985,097

[45] **Date of Patent: *Nov. 16, 1999**

[54] METHOD FOR SUPPRESSING UNDESIRED EFFECTS OF TRANSITION AND ALKALINE METAL COMPOUNDS DURING BLEACHING

[75] Inventor: Hans Olov Samuelsson, Göteborg, Sweden

[73] Assignee: AGA Aktiebolag, Lidingo, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,221

[22] PCT Filed: Apr. 21, 1995

[86] PCT No.: PCT/SE95/00433

§ 371 Date: Dec. 30, 1996

§ 102(e) Date: Dec. 30, 1996

[87] PCT Pub. No.: WO95/32332

PCT Pub. Date: Nov. 30, 1995

[30] Foreign Application Priority Data

May 24, 1994 [SE] Sweden ..... 9401771

[51] Int. Cl.[6] ..... D21C 9/147; D21C 9/153; D21C 9/16

[52] U.S. Cl. ..... 162/49; 162/62; 162/65; 162/76; 162/78; 162/79; 162/90

[58] Field of Search ..... 162/65, 79, 49, 162/62, 78, 76, 90

[56] References Cited

U.S. PATENT DOCUMENTS

| | | | |
|---|---|---|---|
| 3,759,783 | 9/1973 | Samuelson et al. | 162/65 |
| 4,050,981 | 9/1977 | Jamieson et al. | 162/37 |
| 4,087,318 | 5/1978 | Samuelson et al. | 162/65 |

FOREIGN PATENT DOCUMENTS

| | | | |
|---|---|---|---|
| 92/17639 | 10/1992 | WIPO | 162/65 |
| 94/10375 | 5/1994 | WIPO | 162/65 |

*Primary Examiner*—Steven Alvo
*Attorney, Agent, or Firm*—Pearne, Gordon, McCoy & Granger LLP

[57] ABSTRACT

A method that solves the problem of suppressing disturbing effects of transition and alkaline earth metal compounds during bleaching of chemically digested lignocellulosic pulp in a sequence with oxygen bleaching prior to oxidative stages with introduction of for instance ozone, superoxides, hydrogen peroxide and peroxy acids. The conditions during the oxygen bleaching are chosen so that the properties of these metal compounds are changed and the compounds removed from the pulp during the oxygen bleaching under such conditions that the attack on the cellulose is small and the fluctuations of the pulp quality due to fluctuating amounts of these metal compounds decrease markedly.

11 Claims, No Drawings

METHOD FOR SUPPRESSING UNDESIRED EFFECTS OF TRANSITION AND ALKALINE METAL COMPOUNDS DURING BLEACHING

FIELD OF THE INVENTION

The invention relates to an improved method for removal and changing the properties of metal compounds in chemically digested lignocellulosic pulp prior to bleaching with active-oxygen containing compounds such as ozone, superoxide or peroxide compounds.

BACKGROUND OF THE INVENTION

The process can be applied to pulps from alkaline digestion, e.g. by kraft, counter-current kraft, polysulfide, soda and alkaline sulphite digestion or from digestion at low alkalinity and in acid media, e.g. processes in which sulphite is employed. Before the process according to the invention, the pulp can be screened and the liquor from the digestion removed by known techniques, such as pressing, filtration and washing, more or less completely depending on the starting material, the end-use of the pulp and the envisioned emission of organic solutes which all must be considered also in the choice of the bleach sequence. The end-use can vary from semibleached pulp for packages to almost lignin-free dissolving pulps produced with a large decrease in viscosity which is in this document applied as a measure of the depolymerization of the cellulose. The process is well suited for production of paper pulps of high viscosity, brightness, and brightness stability with less chlorine content and water pollution than comparable pulps produced by previously known processes, e.g. those with $Cl_2$ and with a large addition of chlorine dioxide.

It is well known that metal compounds from the wood, water and employed chemicals can catalyse the depolymerization of the cellulose and hemicellulose. The amounts of harmful metal compounds introduced into the oxygen bleaching depend on the wood, water and other materials and on corrosion. Metal determinations in the raw materials are used to adjust the conditions, e.g. before wood from new suppliers are employed. Magnesium compounds are widely used to suppress the depolymerization of the cellulose. A theory confirmed experimentally by many researchers is that harmful transition metal ions such as iron, copper, cobalt and manganese are coprecipitated with magnesium hydroxide in the alkaline medium and in this way deprived of their catalytic activity.

Soaking of the unbleached pulp with acid to remove harmful metal ions such as manganese before the oxygen bleaching has been applied (Rerolle et al., Pulp and Paper Intern., July 1969, pp 29–31; Smith et al., French Pat. 1 601 408, filed 1970).

Similarly, complexing agents such as aminopolycarboxylic acids EDTA, DTPA and related aminophosphonic acids have been employed, Per G. Lundgren et al. Swedish patent No. 8902058-0. Industrial applications have been reported in publications by Basta et al., (Tappi J. April 1990, 155; Proceed. Appita 1991, Symp. Wood and Pulping Chem., Vol. 1, p. 237) and by Bryant and Edwards (Proceed. Intern. Non-Chlorine Bleaching Conf. March 1994, Xmelia Island, Florida). The cost for environmentally acceptable applications of these techniques can be very high, unless the release of the complexing agents is accepted. Serious problems by the presence of manganese during oxygen bleaching were reported in the patent by Smith et al., while D'Ans et al. (Angew. Chem. 63, 368(1951); 65, 368 (1953), Abbot et al. (J. Pulp Paper Sci. 17, J10 (1991), and Colodette et al. (J. Pulp Paper Sci. 15, J45 (1989) report on problems with manganese catalysis during peroxide bleaches.

Extractions with both acids and complexing agents of these types in separate stages can be used to prepare pulps with extremely low metal contents. No industrial application of this method before bleaching with oxygen or active-oxygen containing compounds seems to have been published. In addition to the high cost for the chemicals and the abatement of the water pollution the pulps are extremely sensitive towards trace amounts of iron compounds. Pulps extracted under conditions leading to very low contents of transition metal compounds such as those of manganese, cobalt, copper and iron are attacked in an irreproducible manner during bleaching in chlorine-free stages. Hence, small variations in the transition metal contents can give rise to serious variations in the degree of delignification (decrease in kappa number), the brightness and viscosity after treatments in stages with oxygen and other active-oxygen containing compounds. These variations are extremely serious for the quality of e.g. viscose pulps and paper pulps for fine paper of extremely high brightness, brightness stability, strength and viscosity and at the same time low carbonyl contents. The reported viscosities refer to intrinsic viscosity, $dm^3/kg$, according to SCAN 15:88. The decrease in viscosity during the oxygen bleaching is used as a measure of the depolymerization of the cellulose. The kappa numbers were determined according to SCAN 1:77.

SUMMARY OF THE INVENTION

The present invention provides a solution of these problems. In addition the invented process can be adapted to a system permitting a virtually complete recovery and burning in a conventional soda boiler of the organic material in the liquors and a production of pulps with extremely high brightness and brightness stability, very low contents of extratives ("resin") and total organically bound chlorine. The invention relates to a process for removal and changing the properties of metal compounds in chemically digested lignocellulosic pulp prior to bleaching in one or more oxidative stages with chlorine-free, active-oxygen containing compounds belonging to the group ozone, singlet oxygen, superoxides, hydrogen peroxide, peroxyacetic acid and other peroxyacids. The process is characterized by one or more oxygen bleaching stages at a consistency in water of at least 4% by weight and with introduction of magnesium and manganese compounds and operating in the presence of organic material, dissolved during oxygen bleaching, and optionally also spent liquors from other stages in the pulp mill to change the chemical composition, the physical state and the localization of Ca, Mg, Ba, Mn, Fe, Cu and other transition metal compounds, before the pulp is brought into the aforementioned oxidative stages with chlorine-free bleaching agents containing active oxygen. The process permits a very extensive delignification already in the oxygen bleaching without serious losses in viscosity and with a reproducible production of bleached pulp with very small variations in the quality even in a virtually closed system for recovery of organic solutes.

A complete elimination of the emission of organic solutes in the spent liquors from the cooking and bleaching is a non-realistic target. A release of less than 2% of the dissolved raw material during bleaching, calculated on a total organic carbon basis can be reached when effective equipment is available for recirculation of liquors and for separation of liquors from the pulp by current techniques without excessive dilution with water. Cf. R. H. Crotogino et al. (Tappi J. June 1987, p. 95); P. S. Bryant et al. (Tappi J.

February 1994, p. 137); P. Axegård et al. (Nordic Pulp Paper Res. J. December 1993, p. 365). With regard to the heat economy and capital cost it is advantageous if a larger emission, e.g. 5% is accepted. Even a larger release, e.g. 10%, can be tolerated in mills with purification of the waste liquors by for instance biological methods. An integrated recovery with the cooking liquors is preferred in mills with liquors containing mainly sodium or potassium ions but can also be employed in sulphite mills on magnesium basis and oxygen bleaching with e.g. hydrated magnesium oxide.

The invention has been tested in comprehensive trials with oxygen bleaching in a laboratory process simulating continuous bleaching in a pulp mill and in our previous publications shown to give results in agreement with those from industrial bleaching. These trials led to the unexpected results that an increased selectivity (viscosity at a given kappa number) could be achieved after an oxygen bleaching under conditions which at the same time changed the metal compounds in the pulp so that a large proportion of the transition metal compounds and alkaline earth compounds were brought into the liquor phase. These can be easily removed, e.g. by washing with suitable liquors from the pulp mill and water.

Two detrimental reactions during bleaches with bleaching agents containing active oxygen such as peroxides, superoxides and ozone are (i) decomposition of the expensive bleaching agents, (ii) depolymerization of the cellulose. They have been studied during several decades but the results are still contradictory and puzzling. Transition metals, even in small amounts of for instance manganese in the pulp promote these harmful reactions. The present invention is based on the unexpected observation that these detrimental effects can be suppressed dramatically by oxygen ($O_2$) bleaching under conditions which change the properties of the metal compounds prior to the bleaching with the other bleaching agents, the working conditions in the $O_2$-stage being chosen so that the depolymerization of the cellulose is low in this stage. The chemical composition of the transition metal compounds are changed by oxidation, for instance of Mn of oxidation state +II to average oxidation states between +III and +IV. The oxidation state can be brought to the desired level by changes of for instance the oxygen pressure, alkali concentration and temperature. The oxidation state has predominant effects both on the ability of the metal ions to give complexes with different ligands and the formation of compounds with very low solubility in aqueous solutions. The examples show that both transition metal compounds and the alkaline earth compounds can be linked to lignin containing colloids under conditions given in the examples. Other changes in the chemical composition are hydrolysis which promotes the formation of polynuclear oligomers and lignin containing colloids mainly of hydrated magnesium oxides and basic magnesium salts. Dehydration can result in flocculation.

Like other processes including bleaching of pulp the process according to the invention is controlled by analyses of the pulp, e.g. determinations of lignin (e.g. kappa number), viscosity and brightness and by determinations of pH and light absorption in the liquors. Known automatic methods can be employed. Determinations of metal contents in the pulp give unreliable information about the catalytic and retarding effects of different metal compounds during oxygen bleaching. This may in part be ascribed to different effects exerted by different compounds of the same element, e.g. of Fe and Mn on the delignification, the depolymerization of the cellulose and the formation of carbonyl groups. Their formation in intermediate reactions of great importance is still largely unknown. As shown in the examples according to the invention and control experiments given below, the effect of the compounds of one transition metal in the system can be affected strongly and in an unexpected way by the amounts of other transition metal compounds and by alkaline earth metal compounds such as magnesium and calcium compounds.

DETAILS OF THE INVENTION

Our trials show that (i) a markedly decreased consumption of chlorine free, active-oxygen containing compounds, (ii) an improved quality of the pulp (e.g. increased viscosity) and (iii) suppressed fluctuations in the pulp quality can be obtained by controlling and adjusting the process conditions based upon determinations of the concentrations of transition metals and alkaline earth metals (Ca, Mg, and Ba) in the liquor phase during the oxygen bleaching. Monitoring the oxygen bleaching based on continuous determinations of one or preferably several transition metals and alkaline earth metal compounds in the liquor is a preferred embodiment. Other determinations can be included in the computer program.

The unexpectedly great advantages of this technique compared to metal analyses of the pulps can be ascribed to the combined effect of several observations, some of which are still puzzling. One of these effects is ascribed to the presence in the pulp of compounds of one and the same metal dissolved at markedly different rates during the oxygen bleaching. Some compounds even seem to be virtually insoluble and inactive while other compounds are dissolved rapidly under the conditions according to the invention. Calcium ions retard the dissolution of magnesium ions. The behaviour of magnesium compounds is very important and more complex than believed earlier. All factors which affect the concentration and state of dissolution (low molecular weight complexes and colloids of different size) of magnesium compounds are important.

Another factor which complicates the interpretation of the results but can be utilized to improve the selectivity and decrease the alkali consumption is the wet combustion in the liquor of dissolved lignin fragments and other organic compounds. An increased temperature, alkali addition, consistency and oxygen pressure can be used to increase the wet consumption, when desired. The reaction seems to be catalysed or retarded depending, on the proportion of Mg:Mn in the liquor.

According to a preferred embodiment the oxygen bleaching is operated with recirculation of liquors from the oxygen bleaching and with introduction of solutes from bleaching stages after the oxygen bleaching. These solutes are preferably present in liquors from an integrated system for recovery of bleach liquors from the oxygen bleaches and the subsequent stages. Known systems applied in other bleaching methods, e.g. counter-current recovery with conventional equipment for filtration, pressing and washing can be used. Preferably the pH, temperature, time and recycling are adapted so that at least 40% of the total amount of magnesium is present in the liquor at least during the final 5-min. period of the oxygen bleaching. This embodiment has the advantage that the process can be operated without magnesium from external sources which is important both with regard to the cost, the environment and the troubles such as scaling of precipitated hydrated magnesium oxides in the equipment used in the bleach plant.

When extremely large amounts of for instance Mn are present in the pulp soaking of the pulp with $SO_2$-water, sulfuric or nitric acids can be employed so that optimum conditions can be reached in the process according to the invention. Metal compounds such as those of Mn can also be extracted by pretreatments with acid-producing compounds belonging to the group NO—X where X is O, OH, O—$SO_3H$ and O—$SO_2H$. Mixing is performed at a temperature from +5° C. to +100° C. A consistency of 2–35% can be employed. These agents can also be employed for a partial delignification and modification of the lignin so that the delignification in subsequent alkaline stages is facilitated, M. D. Jayawant et al. (EP 0 377 981 A2). The examples show that pretreatments with nitrogen oxides before the process according to the invention gave rise to excellent results.

Our trials show that it is possible to carry out a very extensive delignification during oxygen bleaching with an unexpectedly low decrease in viscosity, when the alkali charge is less than 3.5 w/w % calculated as NaOH on bone dry (BD) pulp. Oxidized white liquor can be applied. Additions of $NaHCO_3$ and $Na_2CO_3$ are recalculated to NaOH so that the number of sodium ions is the same. The sodium ions dissolved in recirculated liquors are not included. The pH in the process liquor is controlled. The pH prior to the last 5-min. period is preferably brought to 5.5–9.5.

The preferred temperature during the oxygen bleaches is 90–13° C. when NaOH or oxidized white liquor are added and 120–160° C. when sodium carbonates are instead employed.

Surprisingly, our trials showed that under preferred working conditions large amounts of colloids were present in the process liquors during the oxygen bleaching. When the control of the process is supplemented by studies on-line of these colloids by available techniques, preferably combined with UV-VIS-spectra of the solution, additional improvements can be predicted.

When the target is a virtually closed recovery system the final bleaching after the oxygen bleaching is preferably carried out without application of elemental $Cl_2$ or hypochlorite. Application of oxygen is preferably employed in a conventional manner in stages with peroxide and superoxide bleaching. This leads to lower chemical costs and in most systems to an increased viscosity and brightness which is an advantage in most end-uses. The presence of oxygen in ozone stages is also advantageous both with regard to the economy and to pulp properties. When extremely high brightness and viscosity (paper strength) is required one or more chlorine dioxide stages can be employed in the sequence with the active-oxygen containing bleaching agents. A preferred embodiment is the introduction of chlorine dioxide in connection with the ozone bleaching, either before or after the ozone without washing or with incomplete removal of the liquor between these additions. It can be predicted that on-line application in connection with the present invention will give advantages similar to those reported by Larsson and Samuelson under other conditions (Nordic Pulp Paper Res. J. 5 (4) 180 (1990)).

In the trials, claims and description the concentrations in the liquor phase during a bleaching refer to those found after rapid removal of a sample of the pulp suspension after rapid cooling to 20–22° C. The sample is in our laboratory method passed over a Buchner funnel under suction so that a uniform filter cake with a height of about 1 cm is formed. After pressing, the filtrate is passed twice through the cake to remove suspended material such as short fibers before the analyses are carried out. In a pulp mill with continuous bleaching, liquor samples can be withdrawn on-line under cooling by means of commercially available sampling equipments with devices for removal of solid material, e.g. by filtration and centrifugation. When necessary, the results with the employed sampling devices are compared with those obtained by our laboratory method.

The metal analyses in the process liquors according to the invention are preferably carried out by methods which permit simultaneous determination of several elements of importance for controlling and monitoring the oxygen bleaching. Among instruments tested in the trials Inductive Coupled Plasma Atomic Emission Spectroscopy (IPC) and Atomic Absorption Spectrometry (AAS) have given the most valuable information. Multichannel instruments for AAS with computer control are also commercially available. Our results together with published results achieved with instruments of this type permit the conclusion that these are well suited for on-line monitoring the process according to the invention. Known colorimetric and chromatographic methods, e.g. ion chromatography are valuable especially for control of results obtained with more sophisticated and expensive instruments.

Depending on factors such as the raw material, local conditions, capital costs and end-use of the pulp the partial pressure of oxygen during the oxygen bleaching can be varied from about 0.1 to 3 MPa. For most purposes about 0.2–1.0 MPa is preferred when NaOH and oxidized white liquor are used. A higher pressure, e.g. 0.5–2 MPa is preferred when sodium carbonates are employed.

EXAMPLES 1–17

All treatments were carried out with never-dried pulps. The additions were calculated on bone-dry (BD) pulps. The ultrafiltrations (UF) reported in the tables were carried out with commercial filters with a separation limit at a relative molecular mass of 10000 reported by the manufacturers and calibrated by their standard method. With the equipment available when UF were studied, parallel filtrations were carried out with tighter filters (separation limit 1000). The filtration was slow and some results were not reproducible. No values are therefore included in the tables. The metal concentrations were determined by AAS and checked by calorimetric methods and IPC. Two screened kraft pulps produced from mixed softwood, mainly *Pinus silvestris,* by conventional kraft pulps produced from mixed softwood, mainly *Pinus silvestris,* by conventional kraft cooking in one mill in Southern and one in Northern Sweden were employed in the trials on a laboratory scale.

The pulp referred to in Table 1 was washed with water and soaked with $SO_2$-water of pH 2.2–2.4 and 5% consistency for 30 min at 20° C. After washing with deionized water it was slurried at 5% consistency in EDTA solution containing 6 g per liter of the disodium salt. Sodium hydroxide solution was added and soaking carried out for 2 h at pH 9.2. After washing and an additional soaking with $SO_2$-water, the pulp was washed and centrifuged to a consistency of 32%. All washings were carried out with deionized and subsequently distilled water.

To prepare a large amount of spent bleach liquor containing extremely low amounts of magnesium and catalytically active transition metals several 80 g-batches of the soaked pulp were oxygen bleached in rotating 1500-ml autoclaves at 106° C. and 8% consistency for 120 min. The addition of NaOH was 5% and the initial oxygen pressure 1.0 MPa. This original spent liquor was used in the bleaches reported in Table 1. Samples corresponding to 15 g BD pulp were mixed with 100 g of the original spent liquor, aqueous solutions of manganese(II)sulphate, magnesium sulphate and ammonium iron(III)sulphate (when applied). Sodium hydroxide solution and water were added so that the consistency was 8% and the addition of NaOH 3%, by weight calculated on BD pulp. The oxygen bleaching was carried out in 1500-ml autoclaves at 106° C. The initial oxygen pressure was 0.6 MPa at 22° C.

TABLE 1

Decrease in kappa number and viscosity after oxygen bleaching for 120 and 240 min. in a control (denoted 0) and in examples 1–9. Determinations of magnesium in bleaches with added $MgSO_4$.

| | Additions mmol/100 g | | Decrease kappa no. % | | Loss in viscosity | | Mg in liquor % of added | | Mg in UF % of liquor | |
|---|---|---|---|---|---|---|---|---|---|---|
| Ex. | Mg | Mn | 120 | 240 | 120 | 240 | 120 | 240 | 120 | 240 |
| 0 | 0.03 | 0 | 53 | 59 | 23 | 35 | | | | |
| 1 | 0.03 | 0.55 | 55 | 65 | 19 | 24 | | | | |
| 2 | 4.1 | 0.55 | 53 | 57 | 20 | 24 | 55 | 55 | 20 | 34 |
| 3 | 20.6 | 0.55 | 48 | 56 | 16 | 20 | 51 | 65 | 38 | 47 |
| 4 | 0.82 | 0.11 | 62 | 70 | 18 | 22 | 70 | 78 | 57 | 63 |
| 5 | 4.1 | 0.11 | 55 | 64 | 14 | 22 | 47 | 58 | | 66 |
| 6 | 4.1 | 0.55[a] | 52 | 56 | 16 | 20 | 77 | 82 | 19 | 36 |
| 7 | 4.1 | 0.11[a] | 56 | 61 | 14 | 18 | 93 | 69 | 20 | 37 |
| 8 | 4.1 | 0.11[b] | 56 | 67 | 13 | 18 | 88 | 88 | 25 | 49 |
| 9 | 4.1 | 0.55[b] | 56 | 65 | 14 | 16 | 82 | 85 | 16 | 38 |

a. 0.055 mmol Fe per 100 g pulp.
b. 0.11 mmol per 100 g pulp.

The first experiment in Table 1 shows that in this control without introduction of Mn the loss in viscosity was larger than in the examples 1-9 according to the invention. In comparison with the control an increased delignification and a markedly suppressed attack on the cellulose was obtained when an appreciable amount of manganese was present during the bleaching (Example 1). With the same amount of manganese and an amount of magnesium, commonly applied in bleach plants to protect the cellulose, no protection was obtained (Example 2). The delignification was retarded which means that a loss in selectivity occurred. With the same manganese amount and a decreased magnesium addition by 50% a serious loss in viscosity occurred without significantly improved delignification. These effects of magnesium on the attack on the cellulose were unexpected. Example 3 with a fivefold amount of magnesium compared to Example 2 shows that the increase gave rise to an improved viscosity and a retarded delignification. These results could be expected from the well-known theory for coprecipitation. As shown in the table the major proportion of the added magnesium was, however, present in the solution, indicating that the protection of the cellulose was mainly due to magnesium ions present in the liquor, most probably as polymerized magnesium compounds in colloidal form. Spectrophotometric investigations showed that the colloids contained a large proportion of the lignin fragments dissolved from the pulp. Example 4 with 0.11 mmol Mn and 0.82 mmol Mg per 100 g pulp exhibited a more effective delignification than any of the other bleaches. The increased amount of Mg to 4.1 mmol led to a decreased delignification (Example 5). An enhanced viscosity by this change was found after 120 min while no significant gain was obtained after 240 min. A severe selectivity loss occurred.

Iron salts in small amounts are known to catalyse the depolymerization of the cellulose severely. Accordingly, a control with addition of 0.05 mmol of Fe under conditions which otherwise were the same as those in the first experiment (control) in the table increased the viscosity loss to 45 and 60% after 120 and 240 min, respectively. The presence of small amounts of both Mg and Mn under otherwise unchanged conditions gave rise to a prominent increase in selectivity. Examples 6–9 according to the invention show that the cellulose was protected effectively by the presence of proper amounts of both Mg and Mn in the same bleaching also when this amount (0.05 mmol) or a doubled amount of iron salt was present.

The unbleached pulp referred to in Table 2 was pre-treated with 2% (w/w) $NO_2$ calculated on BD pulp after impregnation with 11.1 kg per 100 kg BD pulp of the same black liquor as used by Samuelson and Öjteg (Tappi J. June 1991, p. 155). This impregnation was carried out to simulate an integrated recovery system. A batch, corresponding to 180 g BD pulp, of 27% consistency was in the 3400-ml reactor brought in contact with the nitrogen dioxide at 60° C. After 15 min. a diluent containing nitric acid and sodium nitrate and simulating spent liquor from the pretreatment was mixed with the pulp so that the consistency was lowered to 8%. The pulp was heated to 80° C. and ripened at 80° C. for 120 min. The shorter ripening time and lower temperature than in most experiments in the aforementioned paper were chosen due to the lower viscosity of the untreated pulp studied in the experiments in Table 2.

After washing with deionized water 10 g batches (calculated as BD pulp) were oxygen bleached at 8% consistence and 106° C. in the 1500-ml autoclaves. Solutions of $MgSO_4$ and $MnSO_4$ were impregnated into the pulp before addition of sodium hydroxide. The standard oxygen pressure (initial) was 0.6 MPa determined at ambient temperature. Deviations from the standard conditions are reported in the presentation of the results. The untreated pulp had kappa number 24.1 and the viscosity 1140 $dm^3$/kg. After the pretreatment and washing with water the values were 16.3 and 1040, respectively.

TABLE 2

Decrease in kappa number and viscosity after oxygen bleaching for 120 and 240 min. in controls (denoted 0) and in examples 10–17. Determinations of magnesium in bleaches with added $MgSO_4$.

| | Additions mmol/100 g | | Decrease kappa no % | | Loss in viscosity | | Mg in liquor % of added | | Mg in UF % of liquor |
|---|---|---|---|---|---|---|---|---|---|
| Ex. | Mg | Mn | 120 | 240 | 120 | 240 | 120 | 240 | 120 |
| 0 | 0.03 | 0 | 71 | 76 | 20 | 25 | | | |
| 0[a] | 0.04 | 0 | 78 | 80 | 35 | 54 | | | |
| 10 | 0.03 | 0.28 | 76 | 79 | 12 | 13 | | | |
| 11 | 4.1 | 0.28 | 73 | 75 | 11 | 14 | 88 | 86 | 55 |
| 12 | 20.6 | 0.28 | 62 | 67 | 8 | 9 | 64 | 56 | 65 |
| 13 | 0.03 | 0.55 | 75 | 77 | 11 | 13 | | | |
| 14 | 0.03 | 0.11 | 75 | 76 | 17 | 18 | | | |
| 15 | 4.1 | 0.55 | 76 | 79 | 15 | 16 | 56 | 70 | 60 |
| 16 | 20.6 | 0.55 | 68 | 71 | 7 | 8 | 59 | 57 | 65 |
| 17[a] | 20.6 | 0.55 | 75 | 81 | 24 | 28 | 27 | 38 | |

a. 6% (w/w) of NaOH on BD pulp.

The two first experiments in Table 2 are controls. They show that contrary to results reported by several investigators the removal of manganese under applied conditions led to serious losses in viscosity and selectivity after the oxygen bleaching. Strongly improved viscosities and selectivities were achieved in the presence of either 0.28 or 0.55 mmol Mn per 100 g pulp while the improvement was somewhat less with 0.11 mmol. The introduction of 4.1 mmol of Mg led to a significant loss in viscosity when the pulp contained 0.55 Mn but had no significant effect for the pulp containing only 0.28 mmol Mn. A fivefold addition of Mg led to a decreased delignification and to an increased protection of the cellulose. The spent bleach liquors from these experiments contained 56–88% of the added Mg. The last experiment shows that an increased NaOH-addition from 3 to 6% (w/w) had a rather small effect on the delignification but led to a markedly increased loss in viscosity. The largest loss in viscosity was obtained in the control with 6% NaOH which is an addition commonly used when the target is to produce pulps of low kappa numbers. Under preferred conditions the total Mg in the liquor phase constituted 56–88% of the totally added amount of Mg. With this pulp which was pretreated with $NO_2$ these high values were obtained without recirculation and introduction of employed liquors into the oxygen bleaching. When desired, recycling can be used to increase the concentration of Mg in the oxygen bleaching also when pretreated pulps are employed.

Our results show that both with the untreated and pretreated pulp a large proportion of the magnesium containing colloids of large dimensions were retained on the coarse UF (separation limit 10000). A small proportion of magnesium passed through the tight filter. A small proportion of magnesium passed through the tight filter (separation limit 1000) can be denoted low molecular mass and oligomeric magnesium compounds. The difference between the amounts in the ultrafiltrates from the coarse and the tight filter represents a fraction of colloids of small dimensions. It can be predicted that further improvements can be gained by more detailed studies in the laboratory and on-line carried out with equipment which has become available during the last few years.

I claim:

1. A process for suppressing undesired effects of transition and alkaline metal compounds during bleaching of a chemically digested lignocellulosic pulp prior to bleaching in one or more oxidative stages with chlorine-free, active-oxygen containing compounds belonging to the group consisting of ozone, singlet oxygen, superoxides, hydrogen peroxide, peroxyacetic acid and other peroxyacids, comprising one or more oxygen bleaching steps at controlled process conditions and a consistency in water of at least 4% by weight, controlling and adjusting the process conditions by continuous or intermittent determinations of the concentrations of Mg and optionally additional alkaline earth metal compounds and Mn and optionally additional transition metal compounds in the bleach liquor after a residence time in the one or more oxygen bleaching steps giving rise to a delignification of at least 20%, operating (i) in the presence of organic material, dissolved from the pulp during the oxygen bleaching, and optionally in the presence of spent liquors from other stages in the pulp mill, so that at least during the final 5 minute period of the oxygen bleaching the ratio of the total amount of Mg in the liquor phase to the total amount of Mg in the liquor phase and in the pulp is at least 40:100, and (ii) with introduction of magnesium and manganese compounds in response to said determinations into the one or more oxygen bleaching steps being operated prior to the aforementioned oxidative stages to change the chemical composition, the physical state and the localization of said Mg and Mn compounds and said optionally additional alkaline earth metal and transition metal compounds, and thereby permitting a reproducible production of bleached pulp with very small variations in quality even with a virtually complete recovery of the organic solutes in the spent bleach liquors.

2. A process according to claim 1, further comprising introducing into said one or more oxygen bleaching steps spent liquors from other steps in the pulp processing.

3. A process according to claim 2, wherein said additional alkaline earth metal compounds are calcium compounds and said additional transition metal compounds are iron compounds.

4. A process according to claim 1, further comprising pretreating the chemically digested lignocellulosic pulp to yield an incomplete dissolution and modification of alkaline earth and transition metal compounds in the pulp prior to the one or more oxygen steps, the pretreating being carried out by contacting the pulp with an acid or an acid producing compound, and mixing at a temperature from +5° C. to +100° C.

5. A process according to claim 4, wherein said acid is selected from the group consisting of $H_2SO_4$, $H_2SO_3$ and $HNO_3$ and said acid producing compound is NO—X where X is O, OH, O—$SO_3H$ or O—$SO_2H$.

6. A process according to claim 1, wherein the one or more oxygen bleaching steps together include a total NaOH charge that is less than 3.5 w/w % calculated on bone dry pulp and wherein additions of $Na_2CO_3$ and $NaHCO_3$ recalculated to NaOH on Na-basis are included in this value while sodium ions in introduced and in recirculated liquors are not included.

7. A process according to claim 1, wherein the pH in the treatment liquor prior to the last 5-min. period of the oxygen bleaching is brought to about 5.5–9.5.

8. A process according to claim 1, wherein the state of solution of magnesium and optionally other compounds is monitored by ultrafiltration, centrifugation, gel permeation chromatography and light scattering.

9. A process according to claim 1, wherein molecular oxygen is introduced in one or more of the bleaching steps with chlorine-free, active-oxygen containing groups.

10. A process according to claim 1, wherein chlorine dioxide in an amount corresponding to less than about 1 w/w % of active chlorine calculated on bone dry pulp is introduced in a separate step after the oxygen bleaching according to the invention.

11. A process according to claim 1, wherein chlorine dioxide is introduced in a bleaching state with ozone.

* * * * *